United States Patent [19]

Kumamoto et al.

[11] Patent Number: 4,812,881

[45] Date of Patent: Mar. 14, 1989

[54] AUTOMATIC IMAGE-DENSITY CONTROL SYSTEM

[75] Inventors: Hidechika Kumamoto; Satoshi Kuroyanagi, both of Sakai; Setsuo Hori, Izumi, all of Japan

[73] Assignee: Mita Industrial Co., Ltd., Osaka, Japan

[21] Appl. No.: 6,843

[22] Filed: Jan. 27, 1987

[30] Foreign Application Priority Data

Jan. 31, 1986 [JP] Japan ..... 61-20877

[51] Int. Cl.[4] ..... G03G 15/00

[52] U.S. Cl. ..... 355/77; 355/8; 355/14 E; 355/25; 355/82

[58] Field of Search ..... 355/8, 14 E, 14 D, 25, 355/82, 77

[56] References Cited

U.S. PATENT DOCUMENTS

| | | | |
|---|---|---|---|
| 3,597,074 | 7/1968 | Murgas | 355/8 X |
| 3,926,518 | 12/1975 | Berry et al. | 355/8 |
| 4,200,391 | 4/1980 | Sakamoto et al. | 355/14 E |
| 4,306,804 | 12/1981 | Sakamoto et al. | 355/14 D X |
| 4,540,279 | 9/1985 | Irie et al. | 355/69 |
| 4,618,244 | 10/1986 | Watanabe | 355/8 |
| 4,627,712 | 12/1986 | Usami | 355/14 E X |
| 4,657,377 | 4/1987 | Takahashi | 355/14 D X |

FOREIGN PATENT DOCUMENTS

| | | | |
|---|---|---|---|
| De 3406568 | 8/1984 | Fed. Rep. of Germany | 355/8 |
| 57-53769 | 3/1982 | Japan | 355/8 |

OTHER PUBLICATIONS

Patent Abstract of Japan No. 61-80173, Makita, 4-2-3-86.

*Primary Examiner*—A. C. Prescott
*Assistant Examiner*—Jane Lau
*Attorney, Agent, or Firm*—Beveridge, DeGrandi & Weilacher

[57] ABSTRACT

An automatic image-density control system for photo-copying the page-to-page content of an open book, in which optimum values (of exposure or development bias) needed for precisely copying the page-to-page content are initially established by performing either continuous pre-scanning of both pages of an open book or pre-scanning of the second page after completing photo-copying of the first page, and then, based on the optimum values thus established in conjunction with the first page content, photo-copying operation for the first page content is executed, and then, based on the optimum values established for the second-page content, photo-copying operation is sequentially executed for the second-page content.

8 Claims, 15 Drawing Sheets

AUTOMATIC IMAGE-DENSITY CONTROL SYSTEM

BACKGROUND OF THE INVENTION

The present invention relates to an automatic image-density control system, more particularly, to an automatic image-density control system for application to an electro-photographic copying machine which is provided with pre-scan format automatic image-density control function and continuous page copying function.

Conventionally, there are a wide variety of modern electrophotographic copying machines incorporating pre-scan format automatic image-density control function and continuous page copying function, while these respectively offer substantial advantages for allowing users to easily obtain high quality copies corresponding to the content of objective book page originals.

When continuously executing photo-copying of page-to-page content using any of conventional electrophotographic copying machines available today, control means first pre-scans the content of the first page and then samples data generated by the pre-scan operation before determining an optimum image density. Then, control means establishes the amount of exposure or development bias in order that the predetermined optimum image density can be achieved. The copying system then executes photographic copying of the first page content, and then by applying the exposure amount and development bias identical to those which were applied to the electrophotographic copying of the first page content, the copying system executes the electrophotographic copying of the content of the second page on.

Nevertheless, any of these conventional copying machines still has a critical problem to be solved. Despite a certain difference present in the kind and density of pictures between the first and second pages, any of these conventional copying machines is obliged to abide by the identical copying requirements for copying the content of the second page by applying the identical exposure or development bias which were applied to the copying of the first page content. More particularly, if the first page contains linear drawings and the second page neutral picture like a photograph, optimum amount of exposure or development bias applicable to linear drawing and optimum requirements applicable to the neutral picture significantly differ from each other. As a result, if a specific amount of exposure and a specific development bias suited for a certain picture were applied to a different picture, it merely results in the reproduction of a noticeably poor-quality picture, and yet, the reproduced picture may not easily be identified in an extreme case. If this occurs, operator is obliged to again execute copying of the content of the page that has turned out the faulty picture.

Although this problem can be solved by applying pre-scan operation immediately before starting with copying operations of the needed pages, it in turn generates another problem of lowering the copying speed due to extended duration for implementing pre-scan operation in conjunction with the total time needed for executing the designated copying operation.

SUMMARY OF THE INVENTION

The primary object of the present invention is to precisely control optimum image density needed for photocopying the content covering respective pages of the objective book.

Another object of the present invention is to minimize time needed for implementing pre-scan operation of respective pages of the objective book against the total time needed for executing the designated copying operation.

The automatic image-density control system related to the present invention first establishes optimum values applicable to the content of respective pages of the objective book to be photocopied by sequentially executing pre-scan operations against the entire content of the first page and the predetermined content range of the second page.

Then, based on the optimum values established for the content of the first page, the system related to the present invention allows the electrophotographic copying machine to execute the photocopying of the content of the first page, and then, based on the optimum values of the exposure and development bias established for the content of the second page, the system allows the electrophotographic copying machine to execute the photocopying of the content of the second page. Note that the optimum value may be of the exposure amount or the development bias.

According to the preferred embodiment of the automatic image-density control system related to the present invention, an optimum value needed for precisely executing photocopying operation covering the content of respective pages of the objective book can be established by sequentially applying pre-scan operations to the entire content of the first page and the predetermined content range of the second page. The electrophotographic copying machine incorporating the system related to the invention is then allowed to apply exposure to the content of the first page in accordance with the optimum value of either exposure or development bias established for the first-page content, and then the exposed image is developed before eventually generating copies containing satisfactory pictures. After completing the photocopying operation of the first page content, the electrophotographic copying machine then applies optimum exposure to the content of the second page using the optimum value of exposure or development bias established for the second-page content, and then it develops the exposed image before generating copies containing satisfactory pictures.

In particular, the electrophotographic copying machine incorporating the automatic image-density control system related to the present invention executes the photocopying operation of the content of the first page in accordance with the optimum value established by the pre-scan operation done against the content of the first page. Immediately after completing photocopying of the content of the first page, the electrophotographic copying machine pre-scans the content of the second page covering only a predetermined range in order to establish an optimum value of either exposure amount or development bias needed for executing the ensuing photocopying operation.

Then, based on the optimum value established for the content of the second page, the electrophotographic copying machine executes the photocopying of the content of the second page. Note that the optimum value to be established by the system related to the present invention may be of the exposure amount or the development bias.

In summary, the electrophotographic copying machine incorporating the automatic image-density control system related to the present invention first pre-scans the full content of the first page before establishing an optimum value needed for correctly photocopying the content of the first page. Then, based on the optimum value thus established, the electrophotographic copying machine applies the needed exposure to the first page and then develops the exposed image before generating copies containing satisfactory pictures. Immediately after completing exposure of the content of the first page, the copying machine pre-scans the content of the second page for establishing an optimum value of exposure amount or development bias. Then, based on the optimum value thus established, the copying machine applies the needed exposure to the content of the second page and then develops the exposed image before eventually generating copies containing satisfactory pictures.

BRIEF DESCRIPTION OF THE DRAWINGS

The present invention will be better understood from the detailed description given hereinbelow and the accompanying drawings which are given by way of illustration only, and thus are not limitative of the present invention in which:

FIG. 2 is the schematic diagram explaining the operations of the automatic exposure control system related to the present invention;

FIG. 3 is the simplified block diagram denoting the constitution of the automatic exposure control system related to the present invention;

FIGS. 5-1 through 5-3 are respectively the operation flowcharts denoting other preferred embodiments of the automatic exposure control system related to the present invention;

FIGS. 8-1 and 8-2 are the operation flowchart denoting the sequential control operations executed by the optical part braking apparatus;

DETAILED DESCRIPTION OF THE PREFERRED EMBODIMENT

Figure 4:
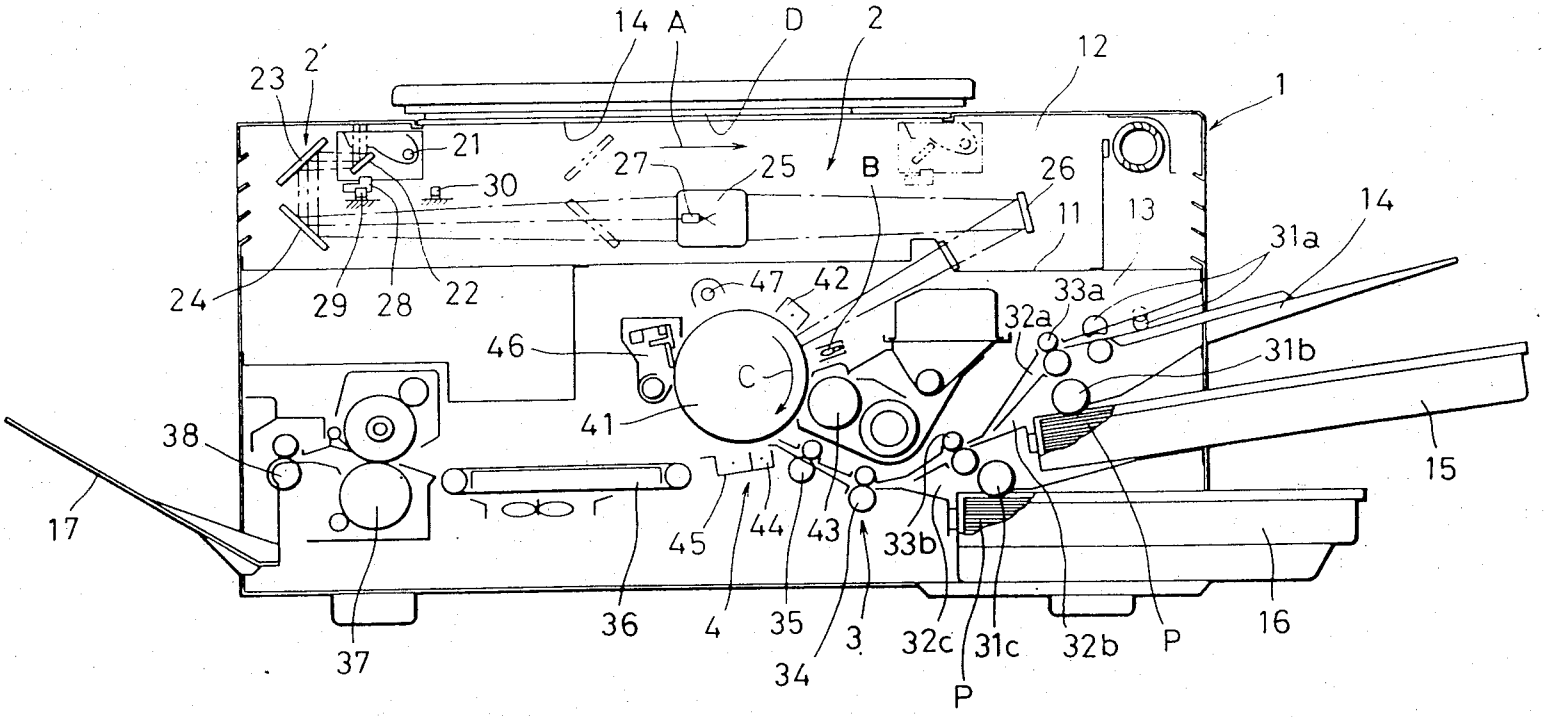
FIG. 4 is the diagram denoting the internal constitution of the electrophotographic copying machine related to the present invention.
Figures 1, 5:
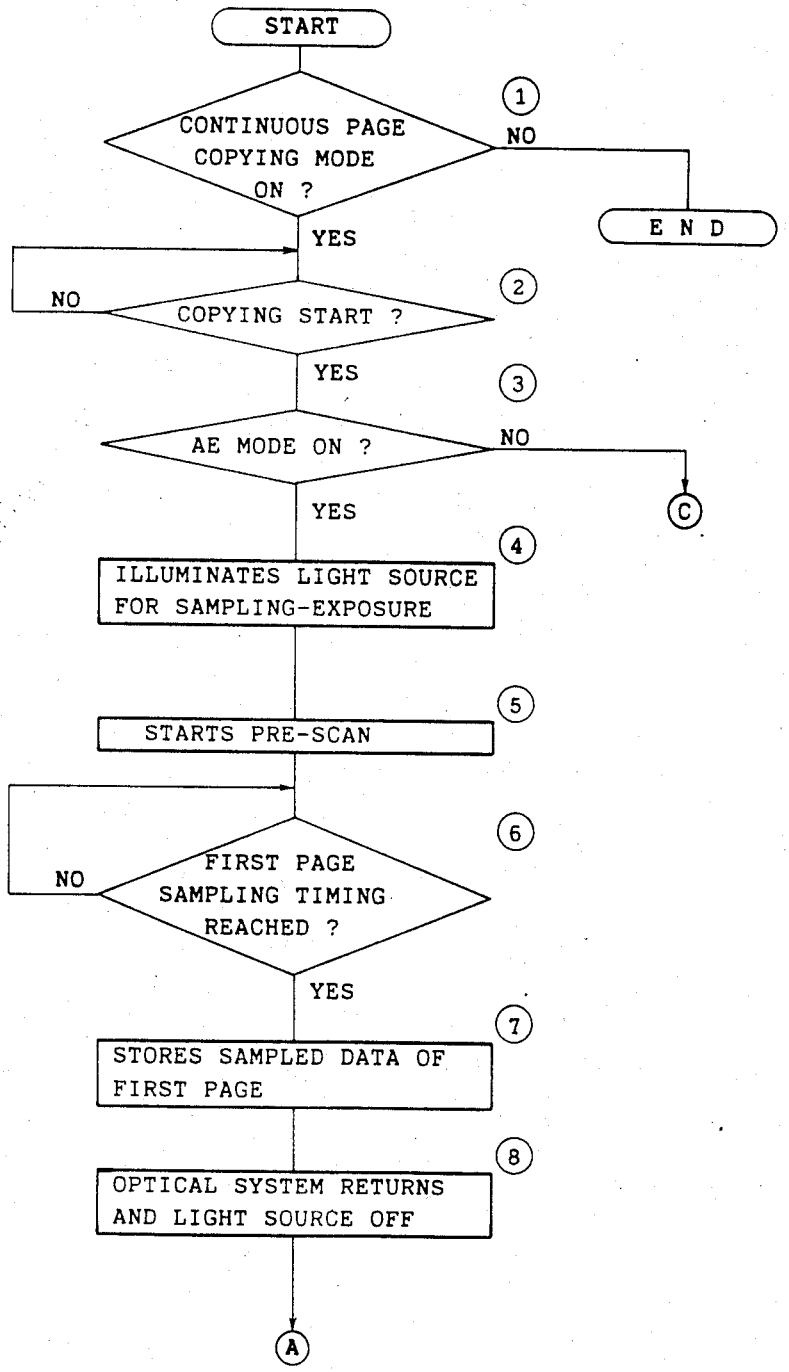
Figures 2, 5:
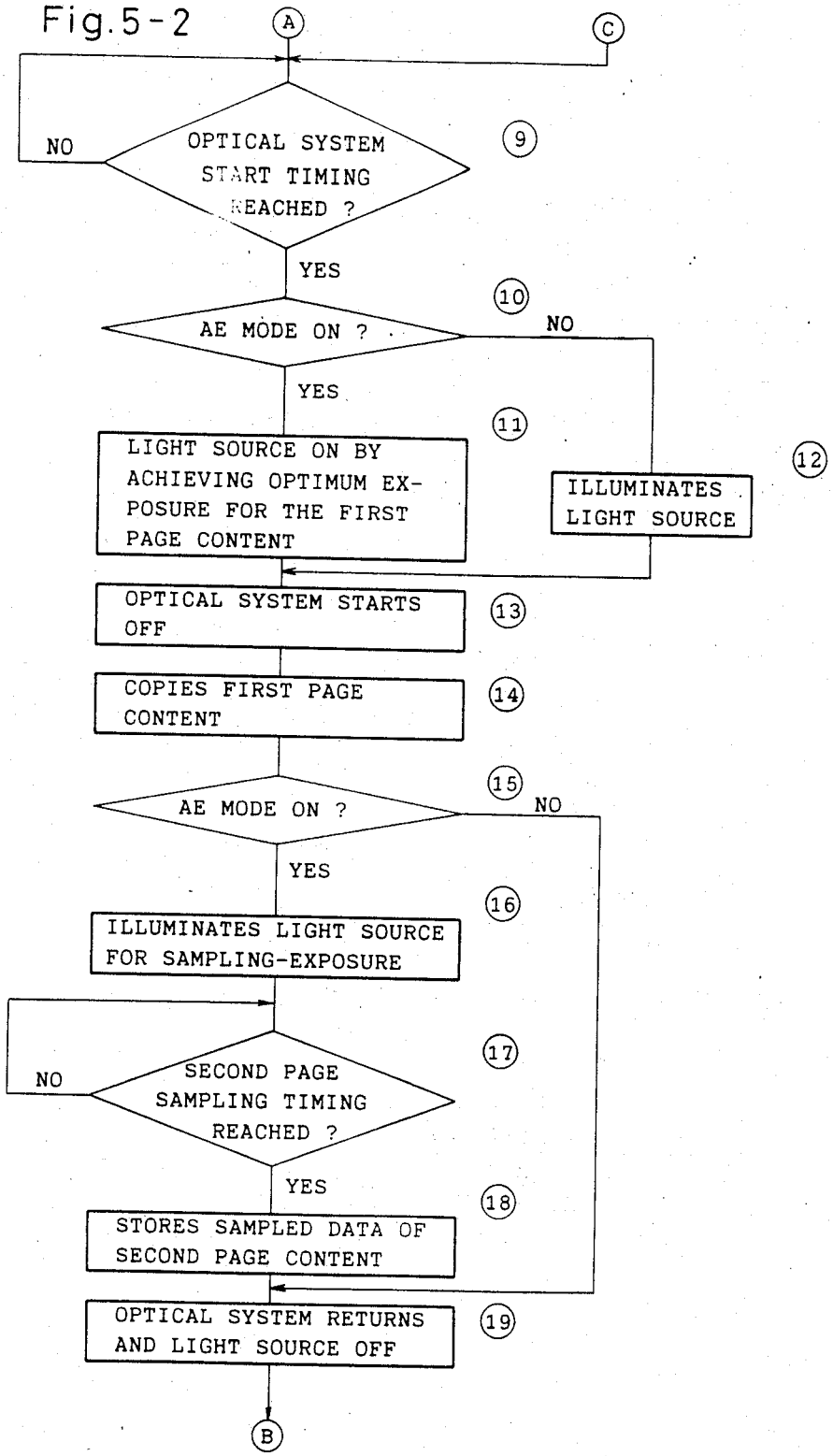
Figures 3, 5:
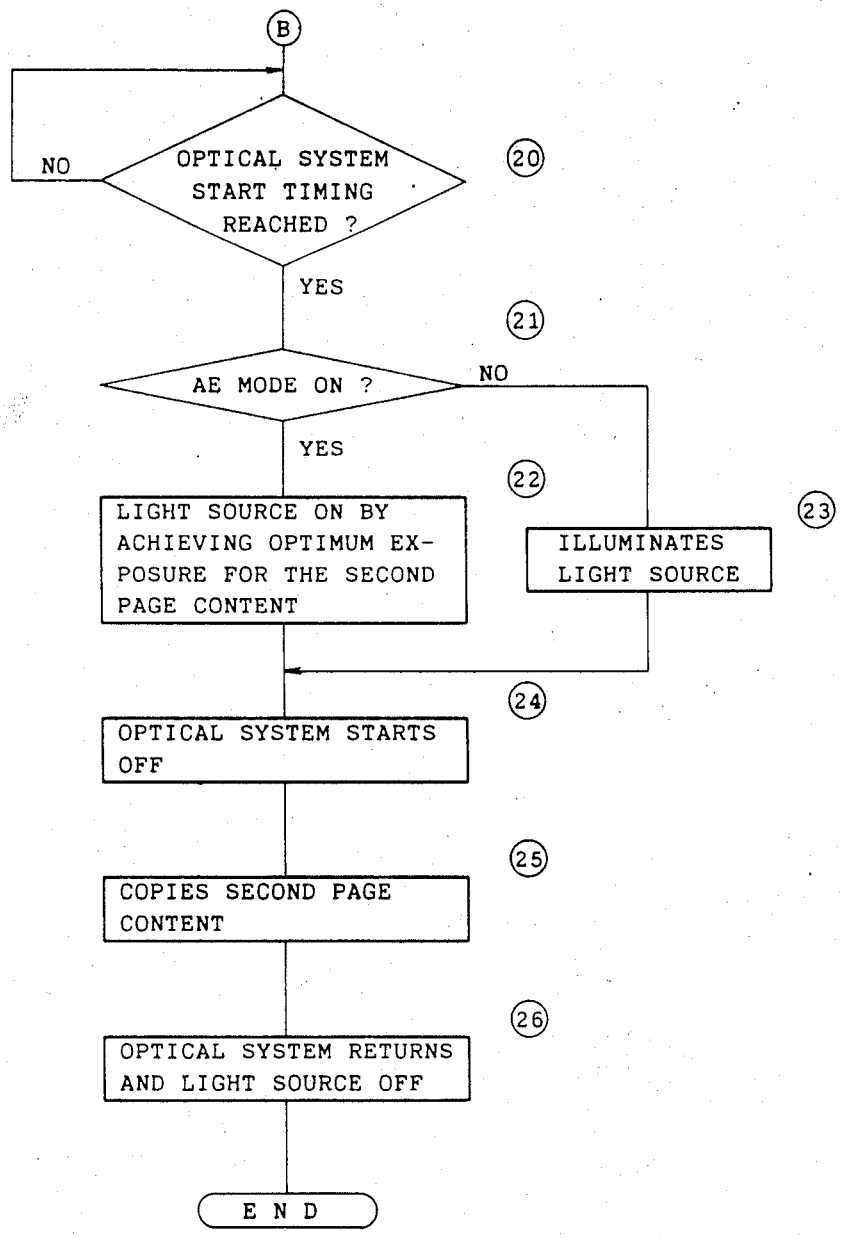

FIG. 4 is the schematic diagram denoting the internal constitution of the electrophotographic copying machine incorporating the automatic exposure control function and continuous page photocopying function related to the present invention.

The photocopying machine 1 is internally divided into an upper chamber 12 and a lower chamber 13 by a partition board 11. The upper chamber 12 stores an optical control system 2 for scanning and applying exposure to an original D, whereas the lower chamber 13 stores an image processing unit 4 generating photocopied picture on the copying paper P and a copying-paper transport unit 3, respectively.

The optical control system 2 incorporates a light source 21, plane reflection mirrors 22 through 24, a lens 25, and another plane reflection mirror 26, while the optical control system 2 scans and exposes the original D on the contact glass 14 by moving the light source 21 and plane reflection mirrors 22 through 24 in the arrowed direction A. The light source 21 and the plane reflection mirror 22 integrally move themselves, while plane reflection mirrors 23 and 24 also integrally move themselves, in which the former moves at a speed that doubles the latter. Note that the light source 21 and plane reflection mirrors 22 through 24 are integrally called optical system 2' in the following description. A photoreceptive element 27 detecting the density of the original is installed to a position close to the lens 25.

In addition, the optical control system 2 also has a light-shutting plate 28 which moves together with the light source 21 and the plane reflection mirror 22 and photointerruptors 29 and 30, while the latter elements are driven by the light-shutting plate 28. The photointerruptor 29 is installed to a position which exactly matches the home position, while the photointerruptor 30 is installed to a position exactly matching the tip end of the original.

The copying-paper transport unit 3 is comprised of paper-feeding rollers 31*a* through 31*c*, paper-feeding routes 32*a* through 32*c*, paper-transport rollers 33*a* and 33*b*, a resist roller 34, a paper-transport roller 35, a paper-transport belt 36, a heat fusing roller 37, and a copied-paper discharge roller 38, respectively. This unit draws out each copying paper P from a stack bypass 14 or either of the paper-feeding cassettes 15 and 16 by selectively driving any of the paper feeding rollers 31*a* through 31*c*, and then the copying paper is delivered to the image processing unit 4 so that toner image can be transferred onto the delivered copying paper. The heat fusing roller 37 then heats the transferred toner image for fixation onto a copied paper, and finally, the copied paper is discharged onto a copied-paper receiving tray 17. Note that the mechanical constitution of the paper transport unit 3 is not limitative of the one described above, but it may also be of any conventional paper-transport system like the one having the paper-feeder inlet and copied-paper outlet in the same side.

The image processing unit 4 is provided with a static charger 42, a blank lamp B, a developer 43, a transfer charger 44, a separation charger 45, a cleaner 46, and a charge cancelling lamp 47, in the order just mentioned on the external circumference of photoreceptive drum 41 which rotates itself in the arrowed direction C. A latent image is generated by imaging the content of the original over the external surface of the photoreceptive drum 41 which is uniformly charged by the static charger 42, and then, after removing the static charge from the peripheral portion without latent image by applying blank the lamp B, the latent image is then developed into the toner image by developer 43. The developed toner image is then transferred onto the copying paper by the transfer charger 44, and then the residual toner is collected by the cleaner 46, and finally, the residual charge is cancelled by the charge cancelling lamp 47. Note that the constitution of the image processing unit 4 is not limitative of the one just mentioned above, but any conventional image processing unit having a photoreceptive belt for example may also be used.

Figure 1:
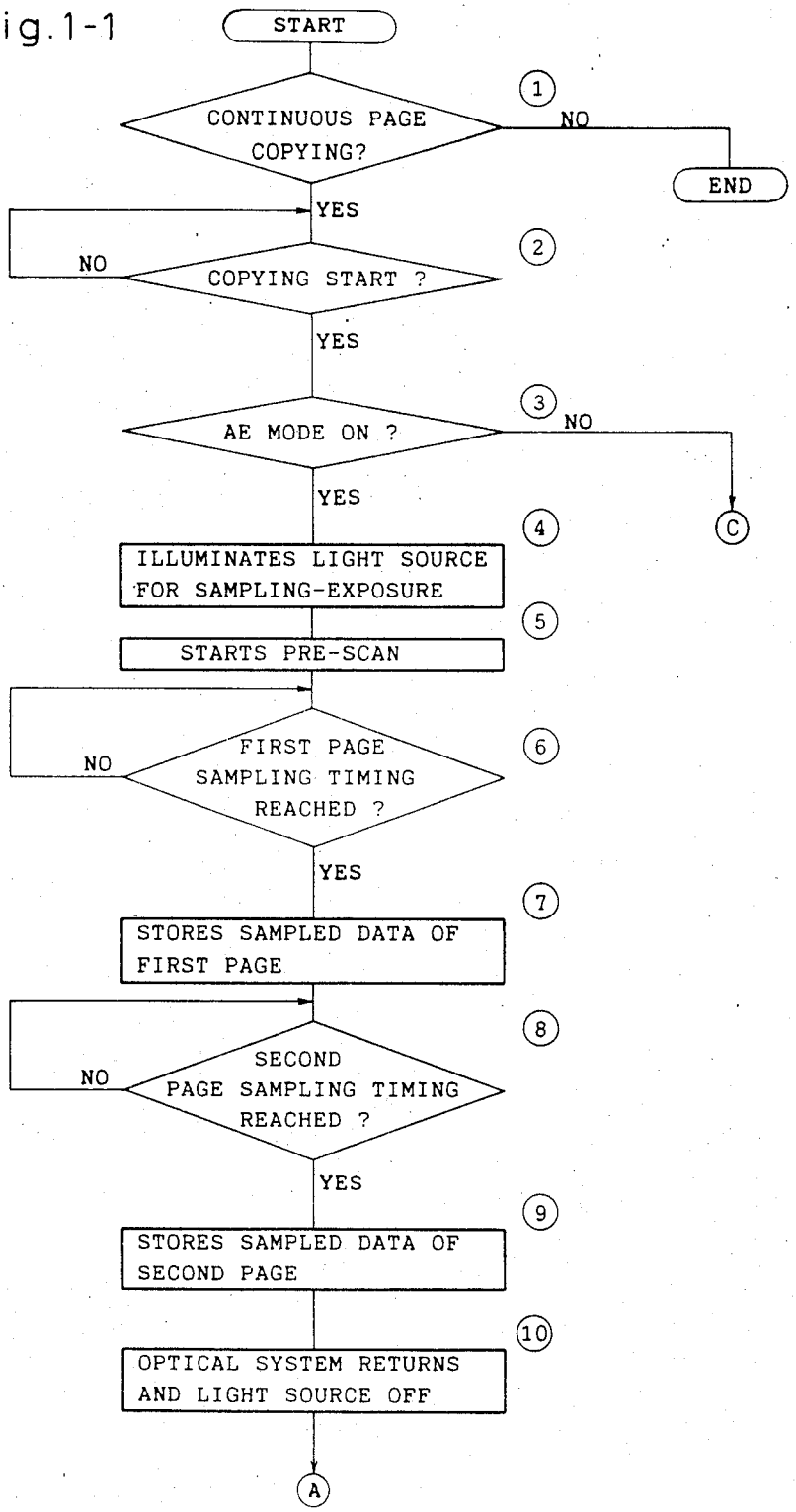
FIGS. 1-1 through 1-3 are respectively the operation flowcharts denoting the preferred embodiments of the automatic exposure control system related to the present invention.
Figures 1, 2:
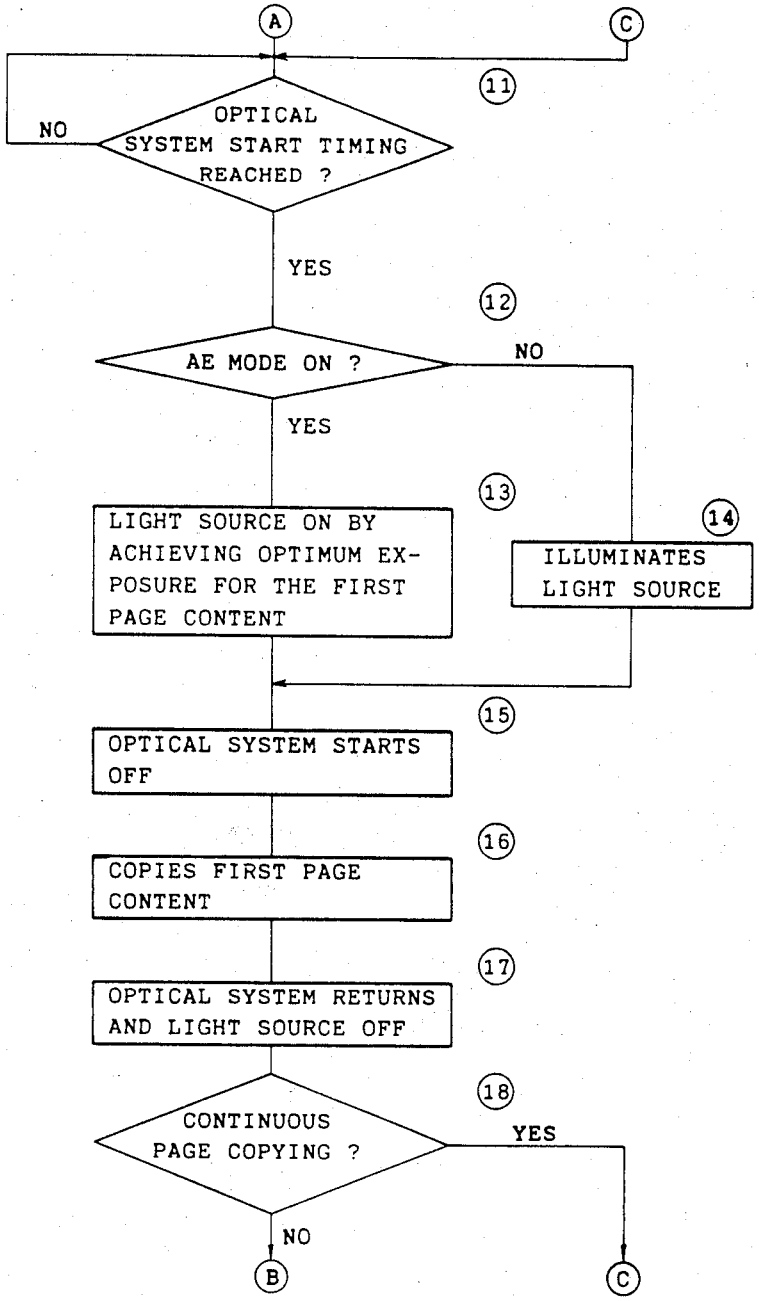
Figures 1, 2, 3:
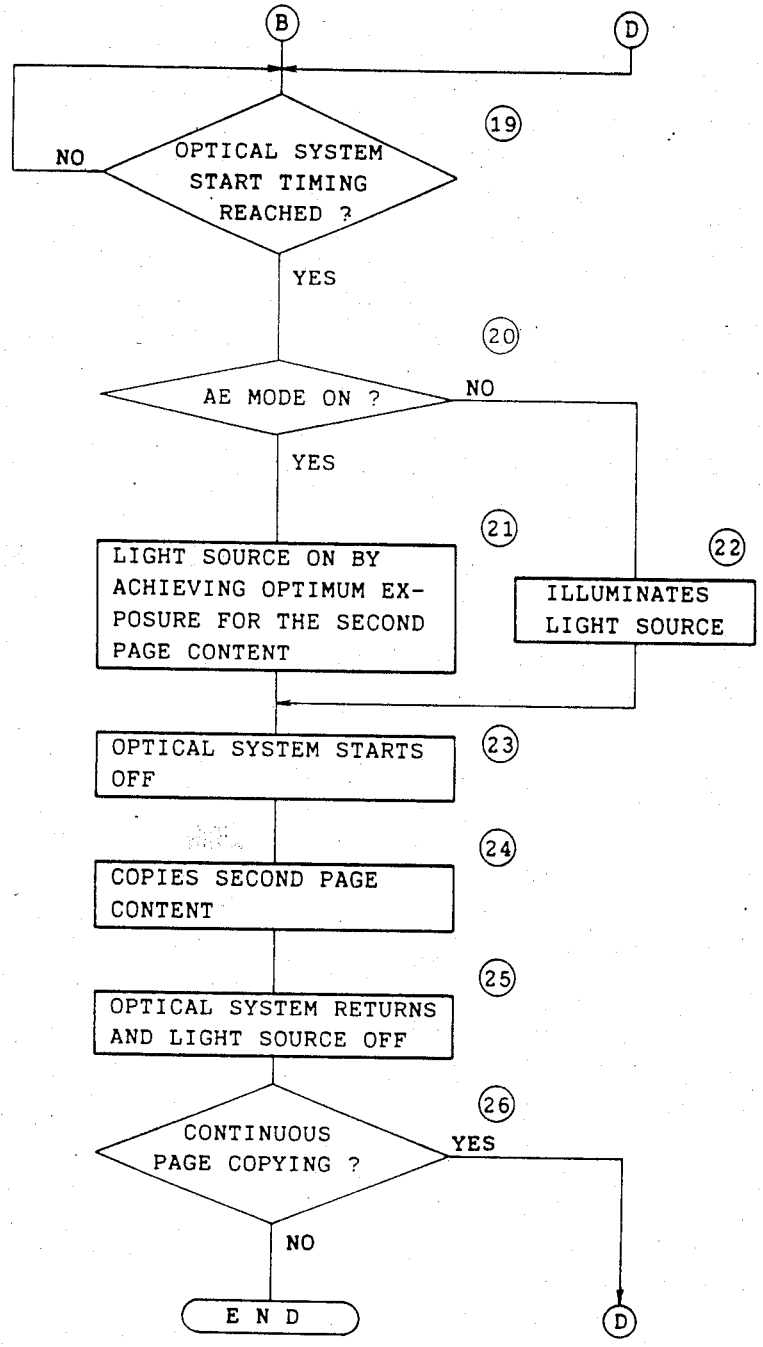
Figure 2:
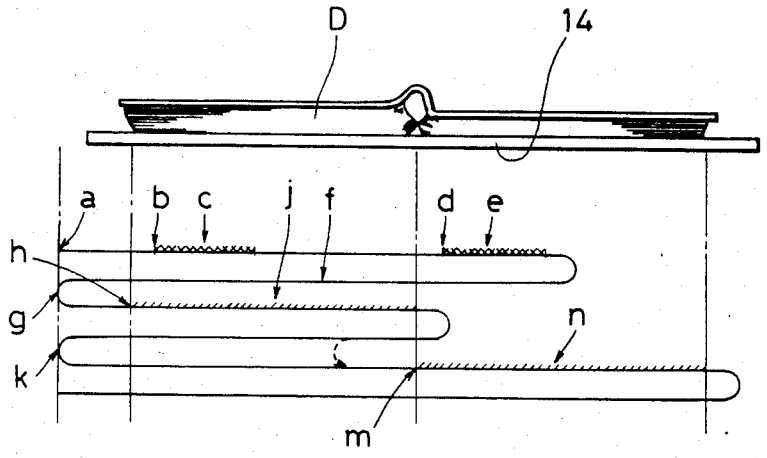
Figure 3:
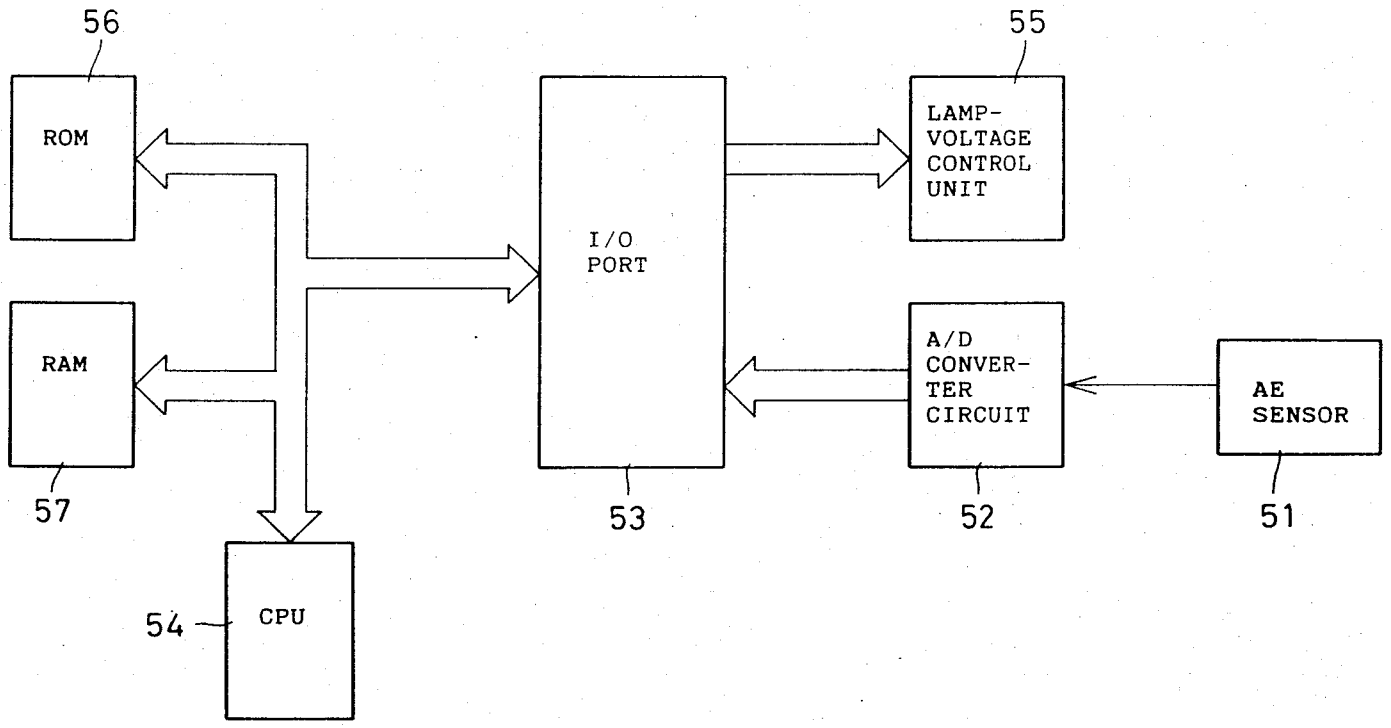

FIG. 3 is the simplified block diagram denoting the constitution of the automatic exposure control system related to the present invention. Signals output from an AE sensor incorporating the photoreceptive element 27 are delivered to a central processing unit (CPU) 54 via an A/D converter circuit 52 and an I/O port 53. A control signal from the CPU 54 is delivered to a lamp-voltage control unit 55 via the I/O port 53. The automatic exposure control system also incorporates a ROM 56 storing a variety of operation programs and a RAM 57 provisionally storing various data.

Referring now more particularly to the operation flowcharts shown in FIGS. 1-1 thorough 1-3 and schematic diagram shown in FIG. 2, operations of the automatic exposure control system are described below.

First, when step 1 is entered, the CPU 54 identifies whether the continuous page copying mode is selected, or not. If the continuous page copying mode is selected, the CPU 54 follows up operations for identifying the following:

The CPU 54 keeps waiting until the copying operation actually begins using the activated print key (not shown) while step 2 is underway. When the operation mode proceeds to step 3, the CPU 54 identifies whether the automatic exposure mode (hereinafter merely called AE mode) is selected, or not.

If it is selected, the automatic exposure control system lights up light source during step 4 for sampling the exposure amount, for example, it lights up light source corresponding to maximum amount of exposure. The automatic exposure control system then activates the forward movement of the optical system 2' during step 5 (see a shown in FIG. 2) to begin with pre-scan operation. When step 6 is entered, the CPU 54 keeps waiting itself until the timing for sampling the content of the first page is reached (see b shown in FIG. 2). When step 7 is entered, the CPU 54 stores sampled data of the content of the first page (see c shown in FIG. 2) into RAM 57. While allowing the light source 21 remains lit, the automatic exposure control system moves the optical system 2' forward furthermore. The CPU 54 then keeps waiting itself during step 8 until the timing of sampling the content of the second page is reached (see d shown in FIG. 2). When step 9 is entered, the CPU 54 stores sampled data of the content of the second page into RAM 57 (see e shown in FIG. 2). Next, when step 10 is entered, the automatic exposure control system turns light source 21 OFF to allow the optical system 2' to start with the return movement (see f shown in FIG. 2).

The CPU 54 keeps waiting itself during step 11 until the timing is reached for starting with the forward movement of the optical system (see g shown in FIG. 2).

When step 12 is entered, the CPU 54 again identifies whether the AE mode is selected, or not.

If it is identified during step 3 that AE mode is not selected, then the CPU 54 keeps waiting itself until the timing is reached for starting with the forward movement of the optical system while step 11 is underway.

If it is identified during step 12 that AE mode is selected, the automatic exposure control system lights up the light source 21 during step 13 by applying a specific exposure amount determined in accordance with the sampled data of the content of the first page. When step 15 is entered, the optical system 2' is activated to move forward itself so that the exposure of the original content can be started (see h shown in FIG. 2). Conversely, if it is identified during step 12 that the AE mode is not selected, the automatic exposure control system the lights up the light source 21 during step 14 by applying the predetermined exposure amount, and then activates the forward movement of the optical system 2' during step 15. When step 16 is entered, the automatic exposure control system executes photocopying of the content of the first page (see j shown in FIG. 2), and then, when step 17 is entered, the automatic exposure control system turns the light source 21 OFF before allowing the optical system 2' to activate the return movement. The CPU 54 then identifies during step 18 whether the continuous page copying mode is selected, or not.

If it is identified during step 18 that the continuous page copying mode is selected, the automatic exposure control system follows up all the operations including identification of mode status and processes covering step 11 on.

If the CPU 54 identifies during step 18 that the continuous page copying mode is not selected, then it keeps waiting during step 19 until the timing is reached for activating the forward movement of the optical system (see k shown in FIG. 2). When step 20 is entered, the CPU 54 again identifies whether the AE mode is selected or not.

If the CPU 54 identifies during step 20 that the AE mode is selected, then the automatic exposure control system lights up the light source 21 during step 21 by applying exposure amount determined in accordance with the sampled data of the content of the second page, and then activates the optical system 2' during step 23 so that exposure of the original content can be started up (see m shown in FIG. 2). Conversely, if the CPU 54 identifies during step 20 that the AE mode is not selected, the automatic exposure control system then lights up the light source 21 during step 22 by applying the predetermined exposure amount, and then, when step 23 is entered, it activates the forward movement of the optical system 2'. The automatic exposure control system then executes photocopying of the content of the second page while step 24 is underway (see n shown in FIG. 2), and then turns the light source 21 OFF and allows the optical system 2' to start with return movement during step 25. When step 26 is entered, the CPU 54 identifies whether the continuous page copying mode is selected, or not. If the CPU 54 identifies during step 26, that the continuous page copying mode is selected, the automatic exposure control system follows up all the operations including identification of mode status and processes covering step 19 on.

Conversely, if it is identified during step 26 that the continuous page copying mode is not selected, a series of continuous page copying operations are terminated.

Using the electrophotographic copying machine incorporating the preferred embodiment of the automatic image density control system related to the present invention, when executing those photocopying operations based on those flowcharts shown in FIGS. 1-1 through 1-3, amount of exposure is properly controlled by referring to the sampled data. The present invention also allows the photocopying operation to be done by means of controlling the development bias instead of controlling the amount of exposure. Even when executing the photocopying operation by means of controlling the development bias, the electrophotographic copying system related to the invention can securely generate highly satisfactory copied papers each containing optimum image density exactly matching the content of each page of the original book.

Furthermore, as shown by broken line of FIG. 2, after completing exposure of the content of the first page, the electrophotographic copying machine related to the present invention allows the optical system 2' to switch the direction of the movement on the way of its return movement into the forward movement for implementing exposure of the content of the second page. In addition, it is also possible for the automatic image density control system related to the present invention to pre-scan the full content of the second page for achieving an optimum amount of exposure or an optimum development bias. Furthermore, sampling may also be done by applying an adequate surface potential sensor.

In summary, the automatic image density control system related to the present invention correctly generates an optimum value of exposure or development bias exactly matching the content of each page of the original book and executes exposure operation against each page by applying the optimum value of exposure amount or development bias as a result of a series of pre-scan operations sequentially applied to the first and second pages as part of the electrophotographic copying operation. Consequently, the electrophotographic copying machine incorporating the automatic image density control system related to the present invention precisely executes the needed photocopying operation by effectively using an optimum exposure value or development bias in conjunction with the images of respective pages of the original book without sacrificing the copying speed at all, thus constantly generating high quality copied papers.

Referring now to FIGS. 5-1 through 5-3 and 6-(A), another preferred embodiment of the automatic image density control system related to the present invention is described below.

First, when step 1 is entered, the CPU 54 identifies whether the continuous page copying mode is selected, or not. If it is selected, the CPU 54 allows the automatic density control system to sequentially execute the following operations needed for implementing photocopying operations.

The CPU 54 keeps waiting itself during step 2 until the photocopying operation is activated by depressing print key (not shown). When step 3 is entered, the CPU 54 identifies whether the AE mode is selected, or not.

If it is selected, operation mode proceeds to step 4, in which the automatic image density control system lights up the light source 21 for executing sampling exposure using luminance corresponding to maximum amount of exposure for example. When step 5 is entered, the control system activates pre-scanning operations (see a shown in FIG. 6-(A)). When step 6 is entered, the CPU 54 keeps waiting itself until the timing for executing sampling of the content of the first page is reached (see b shown in FIG. 6-(A). When step 7 is entered, the control system stores the sampled data of the first page in RAM 57 (see c shown in FIG. 6-(A)), and then, when step 8 is entered, the control system turns the light source 21 OFF to allow the optical system 2' to start with return movement (see d shown in FIG. 6-(A)). When step 9 is entered, the CPU 54 keeps waiting itself until the timing is reached for allowing the optical system to move itself (see e shown in FIG. 6-(A)), and then, when step 10 is entered, the CPU 54 again identifies whether the AE mode is selected, or not.

If the CPU 54 identifies during step 3 that the AE mode is not selected, the CPU 54 follows up its standby mode to be done during step 9.

If it is identified during step 10 that the AE mode is selected, then, when step 11 is entered, the control system lights up the light source 21 using the exposure amount determined in accordance with the sampled data of the first page. When step 13 is entered, the control system activates the forward movement of the optical system 2' in order to begin with the exposure of the first page content (see f shown in FIG. 6-(A)). Conversely, if the CPU 54 identifies during step 10 that the AE mode is not selected, when step 12 is entered, the control system lights up the light source 21 using the predetermined amount of exposure, and then, when step 13 is entered, it activates the forward movement of the optical system 2'. When step 14 is entered, the CPU 54 allows the electrophotographic copying machine to execute photocopying of the first page content (see g shown in FIG. 6-(A)). When step 15 is entered, the CPU 54 again identifies whether the AE mode is selected, or not.

If the CPU 54 identifies during step 15 that the AE mode is selected, the control system then lights up the light source 21 during step 16 for executing sampling exposure by applying luminance corresponding to the maximum amount of exposure. The CPU 54 then keeps waiting itself during step 17 until the timing is reached for sampling the second page content (see h shown in FIG. 6-(A)). Note that the timing of executing the sampling of the second page content exactly corresponds to the moment at which a sampling is done at a specific distance after starting off the sampling operation at a minimum of 50 mm of the distance for example following the completion of the exposure of the first page content. Next, when step 18 is entered, the control system stores the sampled data of the second page content in RAM 57 (see j shown in FIG. 6-(A)), and then, it turns the light source 21 OFF during step 19 to allow the optical system 2' to start its return movement (see k shown in FIG. 6-(A)). When step 20 is entered, the CPU 54 keeps waiting itself until the timing is reached for activating the forward movement of the optical system (see m shown in FIG. 6-(A)). When step 21 is entered, the CPU 54 again identifies whether the AE mode is selected, or not.

If the CPU 54 identifies during step 15 that the AE mode is not selected, then the control system executes the process defined in step 19.

Figure 6A:
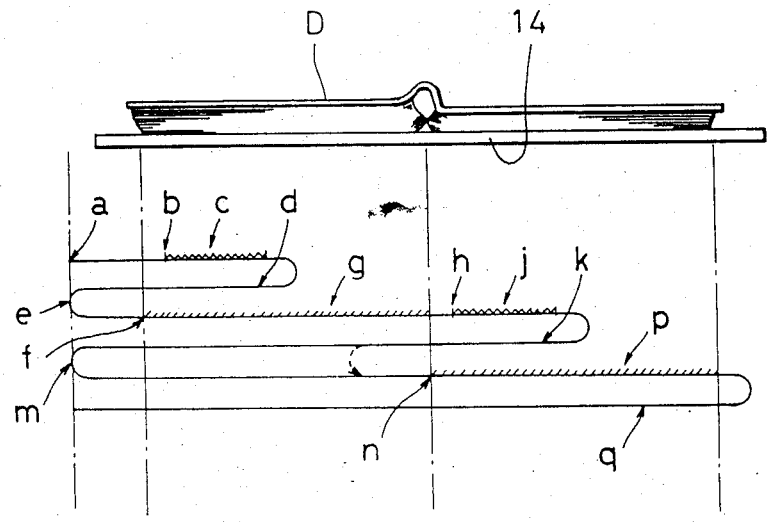
FIGS. 6A and B are respectively the schematic diagrams explaining the operations of the automatic exposure control system related to the present invention.
Figure 6B:
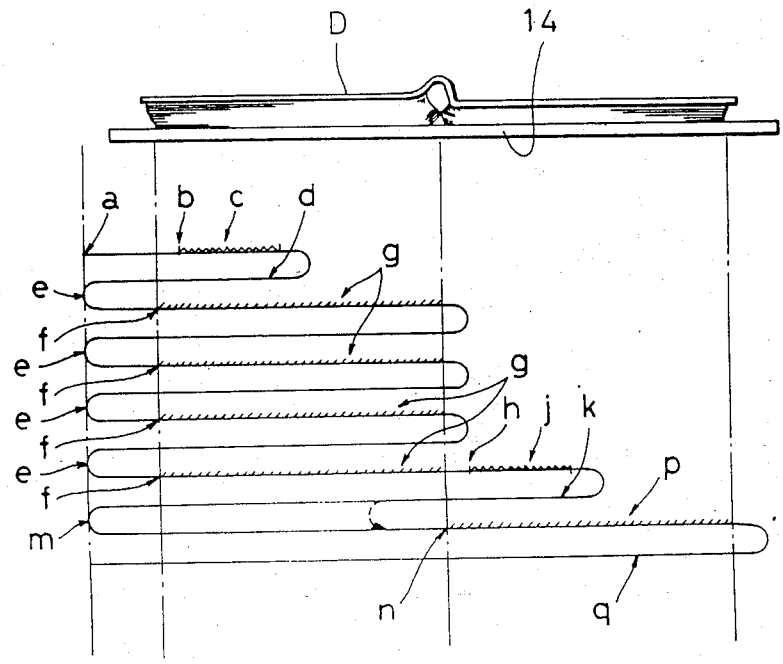

If the CPU 54 identifies during step 21 that the AE mode is selected, operation mode proceeds to step 22, in which the control system lights up the light source 21 by applying the exposure amount determined in accordance with the sampled data of the second page content, and then, when step 24 is entered, the control system activates the forward movement of the optical system 2' in order to start off the exposure of the second page content (see n shown in FIG. 6-(A)). Conversely, if the CPU 54 identifies during step 21 that the AE mode is not selected, operation mode proceeds to step 23, in which the control system lights up the light source 21 using the predetermined amount of exposure, and then, when step 24 is entered, the control system activates the forward movement of the optical system 2'. The control system allows the copying machine to execute photocopying of the second page content during step 25 (see p shown in FIG. 6-(A)). Finally, when step 26 is entered, the control system turns the light source 21 OFF to allow the optical system 2' to start off its return movement (see q shown in FIG. 6-(A)) before eventually completing a series of continuous page copying operations.

FIG. 6-(B) is the operation chart denoting a still further preferred embodiment of the automatic image density control system related to the present invention. Only the difference of this embodiment from the preceding one shown in FIG. 6-(A) is that executing photocopying of the first page content for a plurality of rounds. More particularly, the preferred embodiment shown in FIG. 6-(B) executes exposure of the first page content for a plurality of rounds, and then, after completing the last round of the exposures applied to the first page content, the control system causes the optical system 2' to perform over-scanning operations simultaneous with the sampling of the second page content before eventually applying the optimum amount of exposure to the second page content in accordance with the data obtained by the sampling operation. Accordingly, the preferred embodiment shown in FIG. 6-(B) also allows the electrophotographic copying machine to securely generate quite satisfactory copied papers exactly matching the content of each page of the original book.

Note that the preferred embodiments related to FIGS. 6-(A) and -(B) respectively control the amount of exposure based on the sampled data. However, the spirit and scope of the present invention allow these preferred embodiments to control the development bias instead of controlling the amount of exposure. Even when applying the control of the development bias, the automatic image density control system related to the present invention securely generates quite satisfactory copied papers provided with optimum image density exactly matching the content of each page of the original book.

Furthermore, as shown by broken lines of FIGS. 6-(A) and -(B), the present invention also allows the automatic image density control system to switch the direction of the movement of the optical system 2' from the mid-way of the return movement to the forward movement for executing normal exposure operation after completing sampling exposure by causing the optical system 2' to perform an over-scanning operation. In addition, it is also possible for the control system to light up the light source 21 by applying the luminance corresponding to the amount of exposure used for the exposure of the first page content when starting with the exposure of the second page content. Sampling may also be done by applying an adequate surface potential sensor.

In summary, since the automatic image density control system related to the present invention executes pre-scanning of the second page content immediately after completing the exposure of the first page content needed for implementing the photocopying operation, the electrophotographic copying machine incorporating the automatic image density control system related to the present invention correctly executes the photocopying operation of images from each page content by applying an optimum amount of exposure or development bias without sacrificing the copying speed at all, thus constantly generating quite satisfactory copied papers.

It should be noted however that the electrophotographic copying machine incorporating such advanced functions of those preferred embodiments described above needs to drive the optical system at a specific transfer speed at the moment when starting with the exposure of the original content. To achieve this, after completing the predetermined exposure of the original content, the movement of the optical system should critically be stopped so that the optical system can precisely be held at the home position.

There are a variety of conventional systems proposed for allowing the optical system to correctly stop at the home position as introduced below.

(1) A system for controlling brake time to be started from the moment at which the optical system has returned to a predetermined position before the home position.

(2) A system which first controls the brake time by applying the above system (1) and then allows the optical system to move itself at a slow speed if it is not yet back to the home position.

(3) A system which first detects the speed of the return movement of the optical system at a predetermined position and then control the brake time relative to its return movement.

However, these systems still have problems to be solved. When operating the above system (1), the position of stopping the return movement of the optical system may vary depending on the weight of load applied to the optical system. If load is too heavy, the optical system may stop its return movement before correctly arriving at the home position. Conversely, if load is too light, the optical system may overrun the home position and eventually hit against the mechanical components of the copying machine itself.

When operating the above system (2), if heavy load is applied, the optical system can correctly be stopped at the home position. Conversely, if light load is applied, like the above case, the optical system may overrun the home position and eventually hit against the mechanical components of the copying machine itself.

Figure 10:
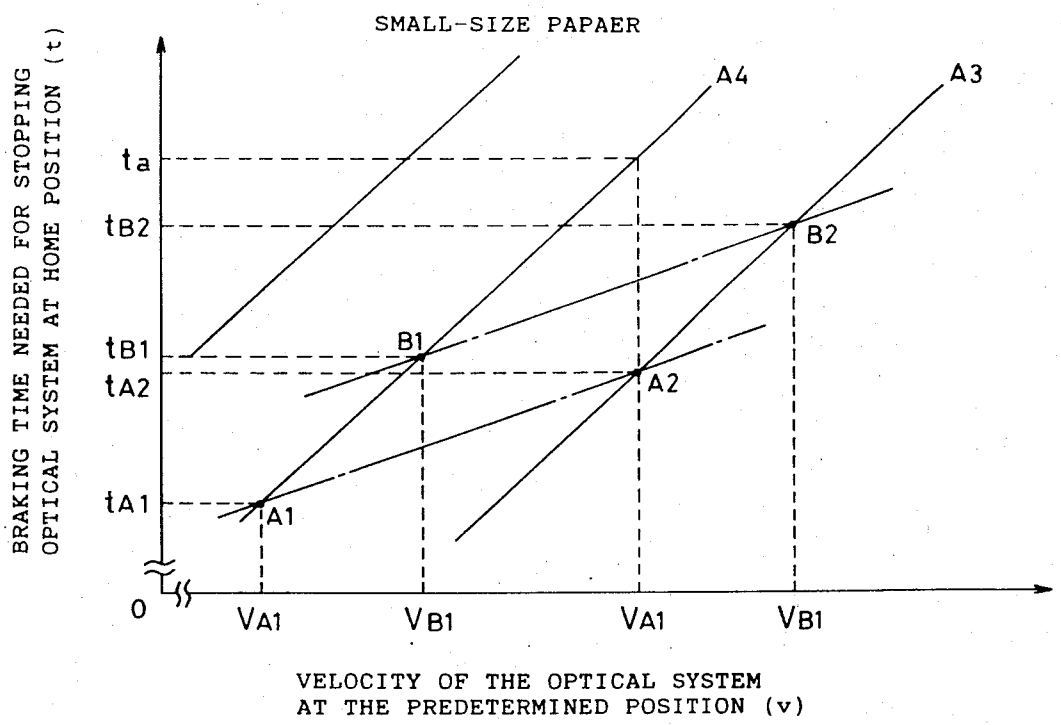
FIG. 10 is graphical chart denoting the relationship between the speed of the return movement of the optical part time and the time needed for stopping its movement.

On the other hand, when operating the system (3), since a certain brake time is provided in response to the speed of the return movement, compared to those control systems (1) and (2) mentioned above, the third control system can relatively improve the precision for stopping the return movement of the optical system at the home position. However, since this system doesn't take the position for starting with the return movement into account, the optical system cannot still precisely be stopped at the home position. Referring now to FIG. 10, particulars are described below. FIG. 10 denotes the relationship between the speed of the return movement of the optical system and the brake time needed for correctly stopping the return movement of the optical system. The position for starting with the return movement of the optical system is determined by the size of the original document and the magnification as well. If this position varies, even if the optical system maintains identical speed of the return movement, the brake time needed for stopping the return movement of the optical system at the home position also varies. As a result, even when properly controlling brake time merely in conjunction with the speed of the return movement, the third system cannot correctly stop the return movement of the optical system when dealing with such an original document having a specific size. Note that the broken lines shown in FIG. 10 respectively denote equivalentcondition characteristics determined by load applied to the optical system. Inclined straight lines A3 and A4 shown in FIG. 10 respectively denote that the optical system starts with its return movement at positions exactly matching the original documents having A3 and A4 paper sizes.

Figure 7:
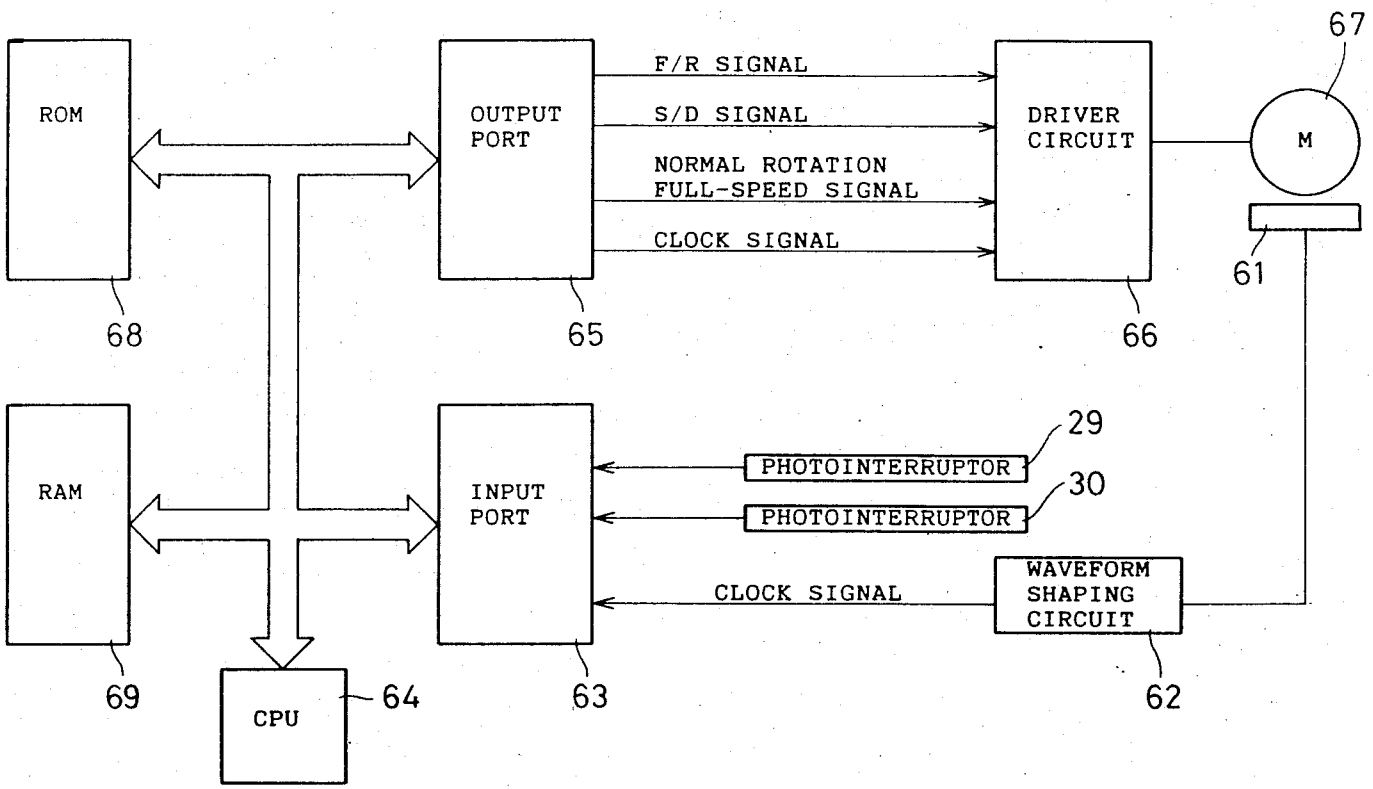
FIG. 7 is the simplified block diagram denoting the constitution of the optical part braking apparatus.

FIG. 7 is the simplified block diagram of the electronic circuit of the optical system braking system related to the preferred embodiment of the automatic image-density control system of the present invention. A waveform-shaping circuit 62 shapes signals from the photointerruptors 29 and 30 and a pulse encoder 61, while the shaped-up signals are then delivered to a CPU 64 via an input port 63. The CPU 64 outputs control signals to a driver circuit 66 via an output port 65, while signals from the driver circuit 66 are delivered to a DC motor 67.

The pulse encoder 61 outputs pulse signals synchronous with the speed of the rotation of the DC motor 67. This braking system is provided with a ROM 68 and a RAM 69, respectively.

Figures 1, 8:
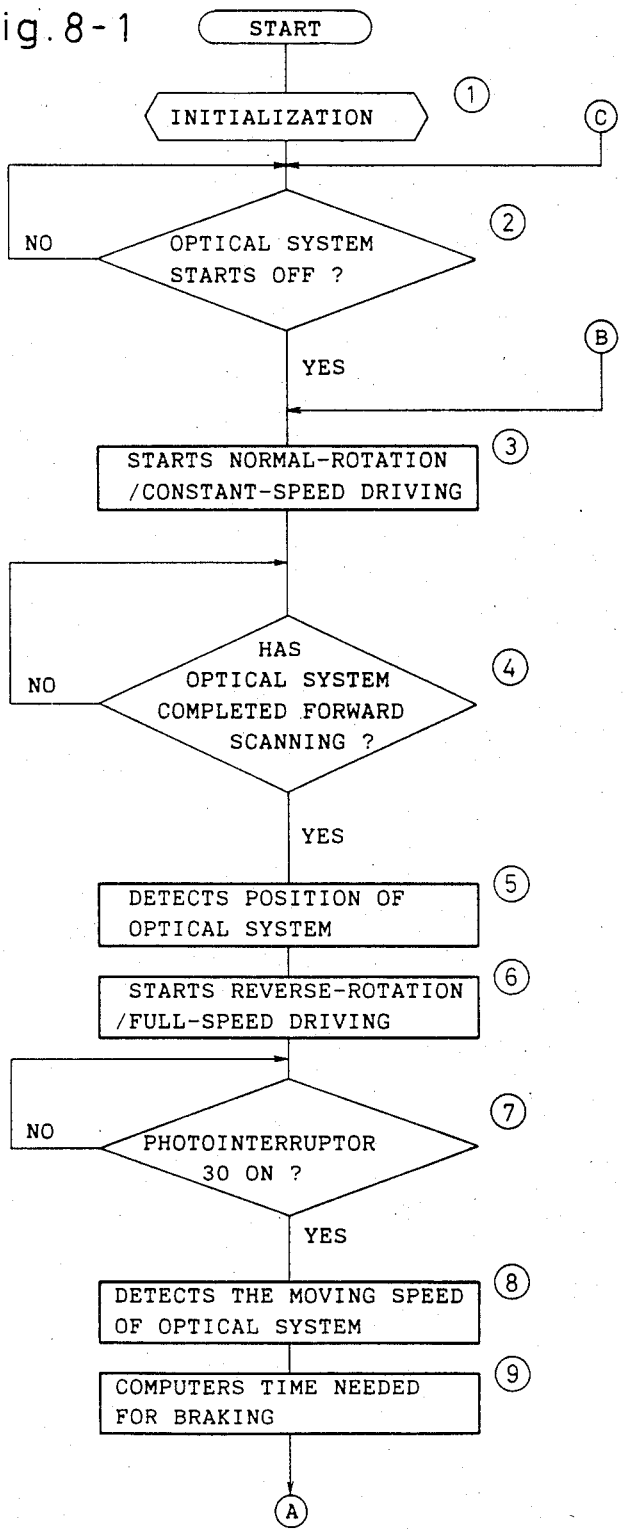
Figures 2, 8:
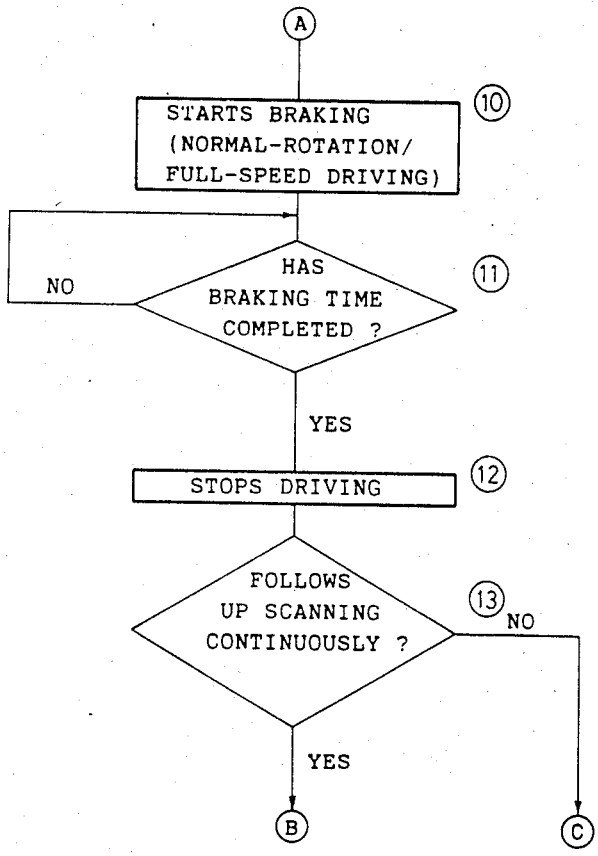

Referring more particularly to the operation flowchart shown in FIG. 8, operations of the optical system braking system are described below.

When step 1 is entered, all the electronic elements needed for executing the photocopying operations are initialized. When step 2 is entered, the braking control system keeps itself in standby mode until the print key is depressed for activating the forward movement of the optical system 2'. Next, when step 3 is entered, the control system drives the DC motor 67 so that it can be rotated forward at a constant speed, thus allowing the optical system 2' to start off its forward movement at a predetermined speed needed for implementing exposure (see a shown in FIG. 9-(B)). When step 4 is entered, the braking control system keeps itself waiting until the optical system 2' arrives at the designated position for stopping its forward movement. When step 5 is entered, the CPU 64 detects the actual position of the optical system 2' by counting the number of pulse signals output from the pulse encoder 61.

Figure 9:
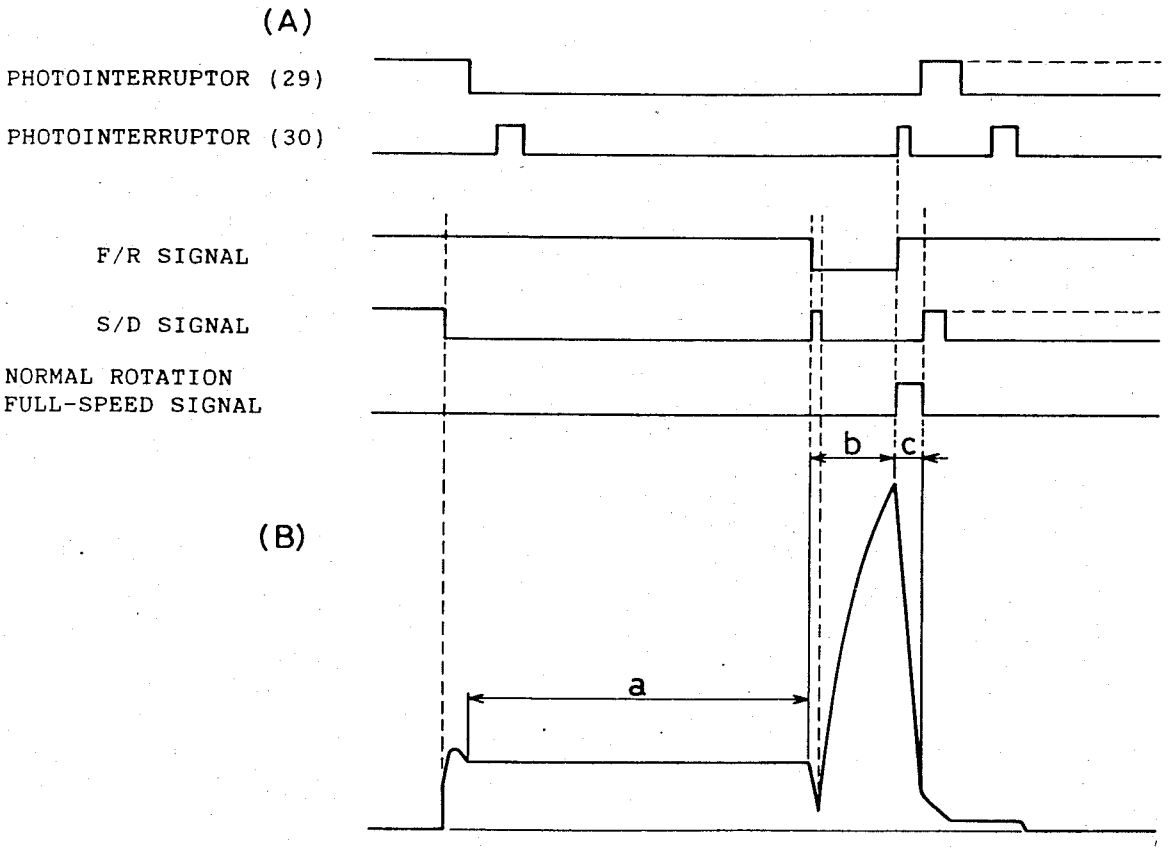
FIG. 9 is the signal waveform chart explaining the operations of the optical part braking apparatus.

Next, when step 6 is entered, the control system drives the DC motor 67 at full speed in the counterclockwise direction to accelerate the return movement of the optical system 2' (see b shown in FIG. 9-(B)). When step 7 is entered, the control system keeps itself waiting until the photointerruptor 30 is activated. Next, when step 8 is entered, the control system detects the speed of the return movement of the optical system 2', in which the operation for detecting the speed of the return movement of the optical system 2' is executed by the operation of the CPU 64 for counting the counted number of counter proceeded during one-clock period of clock signal output from the pulse encoder 61 via the waveform-shaping circuit 62.

Then, operation mode proceeds to step 9, in which the CPU 64 computes the time needed for decelerating the return movement of the optical system 2' based on the actual position of the optical system 2' detected during step 5 and the speed of the return movement of the optical system 2' computed during step 8. The time needed for decelerating the return movement of the optical system 2' is calculated to be the time matching dots on the corresponding straight lines shown in FIG. 10.

Next, when step 10 is entered, the return movement of the optical system 2' is decelerated by causing the DC motor 67 to rotate itself at full speed in the clockwise direction (see c shown in FIG. 9-(B)). The braking control system then keeps itself waiting during step 11 until the time needed for decelerating calculated during step 9 is past. When step 12 is entered, the braking control system stops driving of the DC motor 67. Then, operation mode proceeds to step 13, in which the CPU 64 identifies whether the continuous page copying mode is selected, or not. If it is not selected, the CPU 64 follows up identifying operations covering step 2 on. If the continuous page copying mode is selected, the CPU 64 then follows up identifying operations covering step 3 on.

In summary, even when executing the return movement of the optical system 2' by applying the identical speed at the moment when the actual position of the optical system 2' is detected by the photointerruptor 30, if the position for starting off the return movement varies, the braking control system stops the return movement of the optical system 2' exactly at the home position by varying the time needed for implementing braking operation.

Furthermore, the braking control system may also allow the CPU 64 to identify that the photointerruptor 29 is operative for the confirmation purpose as soon as the braking control system stops the driving of the DC motor 67 during step 12.

In summary, the automatic image density control system incorporating the braking control system securely stops the optical system 2' exactly at the home position by setting a specific time needed for braking the optical system by not only considering the forward movement, but also by taking the position for activating the return movement into ac- count.

What is claimed is:

1. A method for automatically controlling image density in an electrophotographic copying machine have a continuous page copying mode and including an optical system having means movable in a forward direction for scanning and exposing an original and in a return direction for returning to a returned position, said method comprising the steps of:

(a) moving the movable means in the forward direction over a first portion of the content of a first page of an original;

(b) continuing forward direction movement of the movable means over a next portion of the content of the first page and sampling the content of the next portion of the first page to provide data representative thereof;

(c) moving the movable means further in the forward direction over a first portion of the content of a second page of the original before permitting the movable means to move in the return direction;

(d) continuing forward direction movement of the movable means over a next portion of the content of the second page before permitting the movable means to move in the return direction and sampling the content of the next portion of the second page to provide data representative thereof;

(e) generating optimum values for controlling photocopying operations for the content of the first and second pages from the provided data;

(f) photocopying the first page while controlling the photocopying operation according to the generated optimum value corresponding to the content of the first page; and (g) photocopying the second page while controlling the photocopying operation according to the generated optimum value corresponding to the content of the second page.

2. The method of automatically controlling image density according to claim 1, wherein the optimum values substantially correspond to exposure amount.

3. The method of automatically controlling image density according to claim 1, wherein the optimum values substantially correspond to development bias.

4. The method of automatically controlling image density according to claim 1, further comprising, after step (f), the steps of (h) moving the movable means a predetermined distance in the return direction; and (i) reversing the direction of movement of the movable means before the movable means reaches the returned position to move the movable means in the forward direction for photocopying of the second page according to step (g).

5. A method for automatically controlling image density in an electrophotographic copying machine having a continuous page copying mode and including an optical system having means movable in a forward direction for scanning and exposing an original and in a return direction for returning to a returned position, said method comprising the steps of:

(a) moving the movable means in the forward direction from an initial position to pre-scan a portion of the content of a first page of an original to provide data representative of the content thereof;

(b) generating from the provided first page content data an optimum value for controlling a photocopying operation for the content of the first page;

(c) photocopying the first page a predetermined number of times while controlling the photocopying operation according to the optimum value generated from the first page content data;

(d) moving the movable means in the forward direction to pre-scan a portion of the content of a second page of the original to provide data representative of the content thereof before permitting the movable means to move in the return direction after step (c);

(e) generating from the provided second page content data an optimum value for controlling a photocopying operation for the content of the second page; and (f) photocopying the second page while controlling the photocopying operation according to the optimum value generated from the second page content data.

6. The method of automatically controlling image density according to claim 5, wherein the optimum values substantially correspond to exposure amount.

7. The method of automatically controlling image density according to claim 5, wherein the optimum values substantially correspond to development bias.

8. The method of automatically controlling image density according to claim 5 further comprising, after step (d), the steps of (g) moving the movable means a predetermined distance in the return direction, and (h) reversing the direction of movement of the movable means before the movable means reaches the returned position to move the movable means in the forward direction for photocopying of the second page according to step (f) before permitting the movable means to return its returned position.

* * * * *